United States Patent [19]

Simpson

[11] 3,982,043

[45] Sept. 21, 1976

[54] TRIBOELECTRIC FILTER AND METHOD OF USING IT IN AN ELECTROPHOTOGRAPHIC PRINTER

[75] Inventor: Henry Wellington Simpson, Lexington, Ky.

[73] Assignee: International Business Machines Corporation, Armonk, N.Y.

[22] Filed: Mar. 3, 1975

[21] Appl. No.: 554,888

Related U.S. Application Data

[62] Division of Ser. No. 426,750, Dec. 20, 1973, abandoned.

[52] U.S. Cl. ..... 427/14; 55/103; 55/131; 134/6; 355/15; 427/345

[51] Int. Cl.[2] ..... B05D 1/06; G03G 21/00

[58] Field of Search ..... 427/14, 20, 345; 134/6; 355/15; 55/103, 131

[56] References Cited

UNITED STATES PATENTS

| | | | |
|---|---|---|---|
| 2,844,214 | 7/1958 | Hall et al. | 55/103 X |
| 2,992,700 | 7/1961 | Silverman et al. | 55/103 X |
| 3,424,615 | 1/1969 | Eichorn et al. | 134/7 |
| 3,654,901 | 4/1972 | Donohue et al. | 118/637 |
| 3,680,287 | 8/1972 | Wood et al. | 55/524 |
| 3,780,391 | 12/1973 | Leenhouts | 355/15 X |
| 3,816,157 | 6/1974 | Donohue et al. | 355/15 X |
| 3,850,521 | 11/1974 | Saupe | 355/15 |

*Primary Examiner*—Ronald H. Smith
*Assistant Examiner*—Stuart D. Frenkel
*Attorney, Agent, or Firm*—John W. Girvin, Jr.

[57] ABSTRACT

Airborne electrophotographic toner particles are filtered by a body of carrier beads of a material selected to develop a relatively high triboelectric charge upon contact by the toner particles. When the filtering capability of the body of carrier beads is exhausted, the carrier beads and the collected toner are simply mixed into the developer mix of a xerographic machine whereby the collected toner can be reused.

4 Claims, 1 Drawing Figure

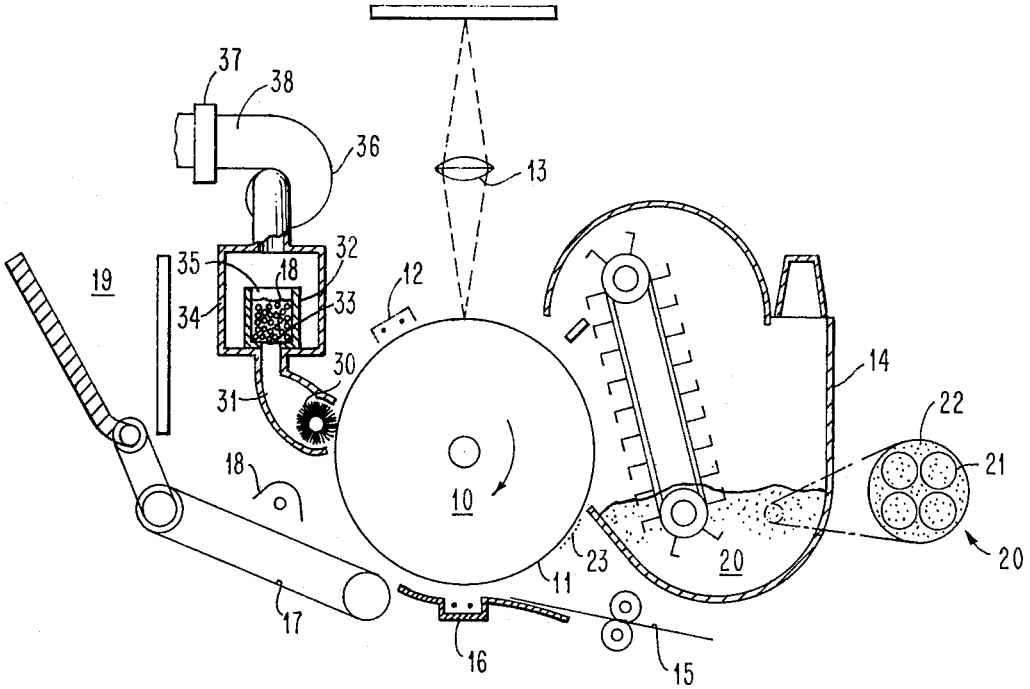
37
38
36
13
32
35
18
19
12
34
33
30
14
31
22
21
18
10
23
20
20
11
17
16
15

TRIBOELECTRIC FILTER AND METHOD OF USING IT IN AN ELECTROPHOTOGRAPHIC PRINTER

This is a division of application Ser. No. 426,750, filed Dec. 20, 1973, abandoned.

CROSS REFERENCE

U.S. patent application Ser. No. 426,749 now U.S. Pat. No. 3,894,514 filed simultaneously herewith in the names of A. H. Caudill, R. J. Hoekzema and C. C. Wilson, entitled "Toner Recovery System" is directed to specific techniques applying the filter of my invention.

BACKGROUND OF THE INVENTION

Xerographic printers, such as plain paper office copy machines, produce images by use of a finely divided, colored dielectric toner powder which is deposited in the form of an image in conformity with an electrostatic latent image carried by an imaging surface. Once formed, the powder image is transferred to a final support sheet and residual toner is cleaned from the imaging surface to prepare it for reuse. The cleaning operation is accomplished by mechanically dislodging the toner particles from the imaging surface and entraining the toner particles in an air stream.

Many cleaning systems in use resemble a household vacuum cleaner employing a brush that dislodges the particles and lifts them into a moving air stream where they are wisked away from the surface being cleaned. The cleaning process may be enhanced by a pre-clean charging treatment and light exposure that provide optimum electrostatic conditions for the cleaning operation. Like a household vacuum cleaner, the toner laden air is ordinarily passed through a cloth-like filter where the toner particles are mechanically trapped to clean the air prior to discharge from the machine. When loaded with toner, the filter bag is usually replaced and discarded.

Electrostatic precipitators have been proposed for cleaning the toner from the air. Such devices provide a strong electrostatic field that tends to drive the toner to a moving surface from which it can be scrapped and collected for re-use. Electrostatic precipitators tend to add cost by requiring both mechanical and electric additions to the copy machine system.

I have discovered that the same carrier beads that interact triboelectrically with the toner material in the developing station to charge the toner material will, if collected in a body through which toner laden air can pass, thoroughly filter the toner particles from the air. The unusual effectiveness of this carrier as a filter material can be explained by the relatively large holding force that is developed upon contact between a toner particle and the carrier bead surface due to the triboelectric relationship between the materials of the particle and the surface. This holding force is substantially greater than the forces placed on the toner particle to cause it to pass through the interstices between adjacent carrier beads. Thus the force of the air stream that brings the toner particle into contact with a carrier bead is substantially less than that necessary to dislodge the toner particle from a carrier bead which it has contacted. This holding force is also large in comparison with forces that might be developed due to the initial charge on the toner and a carrier bead prior to actual contact therebetween, since much of the field that would be created by initial charge within a body of carrier beads tends to be negated by similar charge from adjacent carrier beads.

The ability of developer carrier beads to act as a filter material greatly simplifies the reclamation of toner particles since the toner laden carrier of a saturated filter body can simply be mixed into the developer mix from which the toner originally came.

These and other objects, features and advantages of my invention will be apparent to those skilled in the art from the following description of a specific illustrative embodiment thereof, wherein reference is made to the accompanying drawing, of which:

The FIGURE shows a xerographic copy machine having a cleaning station including a toner filter operated in accordance with my invention.

A copy machine is shown in the FIGURE and includes, a drum 10 bearing a photoconductive imaging surface 11 that in succession is charged by corona unit 12, image-wise discharged by optical system 13 to form a differential electrostatic charge latent image that is developed at developing unit 14 where a development mixture 20 comprising relatively large carrier beads 21 and electroscopic resin toner particles 22 are presented in contact with imaging surface 11 to form a physical powder image 23. Most of the powder image 23 formed by developer unit 14 is transferred to a support sheet 15 by transfer corona unit 16. The sheet 15 is carried by vacuum transport 17 past image fixing means such as a radiant lamp 18 and is deposited in an exit pocket 19. Residual toner particles 22 remaining on imaging surface 11 are mechanically dislodged by brush 30 which wisks them into an air stream in conduit 31. The structure thus far described is conventional in the xerographic art.

To collect toner particles from the air-toner mixture in conduit 31 before ejecting the air from the machine, a container 32 having an open mesh screen bottom 33 is supported in a filter box or housing 34 in alignment with the conduit 31. A body 35 of carrier beads 21 which preferably are identical to carrier beads 21 in the developing station 14 is supported in container 32 in the path of air from conduit 31. Filter box 34 is connected to the vacuum or inlet side of a fan 36 which draws the air through conduit 31 and the body of carrier beads 21. If desired, a fiberous filter 37 may be positioned in the outlet duct 38 of fan 36 to remove any toner particles that might remain.

In operation, toner laden air in conduit 31 is drawn through tortious paths provided by interstices between carrier beads 21 in filter body 35. Toner particles 22 are thereby caused to contact the external surface of carrier beads 21 whereupon a triboelectric charge and resultant holding force is created and the toner particle 22 is electrostatically trapped. Copies are made until carrier body 35 becomes sufficiently laden with toner particles so that it no longer behaves as an adequate filter. Container 32 is then removed from filter box 34 and the toner laden body 35 is poured into the developer unit 14. A like body of developer mixture 20 is removed from developing unit 14 and placed in container 32 thus providing a rejuvenated filter.

The preferred implementation of my invention employs the same carrier material for filtering as is employed in a xerographic development system, an example of which is described in U.S. patent application Ser. No. 226,015, filed Feb. 14, 1972 by C. A. Queener and H. E. Munzel and entitled "Improved Coated Carrier Particles For Use In An Improved Electrophotographic Process". Generally speaking, however, the same triboelectric relationships that make a particular carrier suitable for use as a developer with a particular toner material will qualify that carrier as suitable for use by my invention as a filter for toner material.

The triboelectric behavior of pairs of materials is known to those skilled in the art in a relative sense but is difficult to express in absolute numbers. Under controlled conditions, the triboelectric charge development capability of a pair of materials at least one of which is a dielectric which can be measured in terms of the number of electronic charges produced per linear unit of material diameter. Materials producing higher triboelectric charging upon contact (e.g. 4000 electronic charges per micron of diameter) will exhibit satisfactory filter efficiency whereas those materials producing lower triboelectric charging (e.g. less than 500 electronic charges per micron of diameter) will not.

The inherent filtering efficiency of a carrier material with respect to a particular toner directly determines the size of a body of carrier capable of providing a thorough filter. The more efficient material will thoroughly filter with a shorter air flow path there-through. The air flow path in turn directly affects the pressure that must be applied across the body of material to create the required air flow through the filter. From these relationships, it can be seen that carrier having low triboelectric charge development capability with respect to a particular toner will be required in larger quantity creating a longer flow path through the filter with a resultant required higher pressure drop.

On the other hand, a carrier material having a high triboelectric charge development capability for a particular toner can thoroughly filter with a relatively short air flow path reducing the required applied pressure drop to a minimum.

I have determined that carrier and toner materials having triboelectric charge development capability of about 4000 electronic charges per micron of diameter like that of steel carrier with respect to powdered polyethylene will produce a highly satisfactory filter. Materials having a triboelectric charge development capability of about 1000 electronic charges per micron of diameter such as steel carrier and powdered sulphur will be marginally satisfactory. Materials having a low triboelectric charge development characteristic of less than 500 electronic charges per micron of diameter such as sand carrier with respect to diatomaceous earth will not function satisfactorily according to my invention.

The triboelectric charge development characteristics of any particular pair of materials relative to these exemplary materials can be determined by a variety of known techniques. One technique which I have found convenient and reliable is as follows: A charge of carrier with about 1% by weight toner material thoroughly mixed therein is placed in a 30 Ml. ASTM 10–15 M Buchner funnel, the narrow end of which is connected to a controllable source of metered air pressure. A timed pulsing valve in the air line is arranged to periodically open and pass a puff of air upwardly through the charge of material in the funnel. With materials whose behavior is completely unknown I progressively increase the line pressure and observe whether material is visibly blown out of the sample charge. A good starting pressure is in the order of magnitude of 10 pounds per square inch which I increase up to about 40 pounds per square inch. The pressure attained when material is first visibly blown from the charge is a rough indication of the triboelectric charge characteristic of the material. The higher the pressure, the greater the capability of the materials for developing a triboelectric charge.

To more precisely compare the triboelectric charge development characteristics of an unknown carrier and toner with a known acceptable material, the mixed charge of each sample is carefully weighed before it is loaded into the Buchner funnel. The pressure line for both samples is set to a level previously determined to be capable of noticeably blowing some material from each of the two samples. An equal number of air puffs at this pressure is delivered to each of the two samples, after which the samples are carefully weighed to determine the weight loss of toner from each sample. The sample having the lower weight loss thus is demonstrated as having the greater capability of triboelectric charge development.

In performing this measurement the following variables should be controlled: Relative humidity should be constant and preferably below 50%. The material of the samples should be of the same respective size. Typical carrier bead size is about 300 microns. Typical toner particle size is about 10 microns. The volume of both samples should be substantially constant and the toner concentration should be constant and in the neighborhood of about 1% by weight of the sample. The weighing techniques should be capable of accuracy to at least 0.0001 grams where a sample of nominal size of 50 grams is employed.

Using this test method, I have determined that the charge development capability of a preferred development mixture comprising Teflon-coated steel carrier as described in aforesaid application, Ser. No. 226,015 and a commercial toner designated as IBM Part Number 1162051 described in U.S. patent application Ser. No. 110,756, filed Jan. 28, 1971 by C. A. Queener, et al and entitled "Coated Carrier Particles, Method of Making Same, and Improved Electrophotographic Process" now U.S. Pat. No. 3,778,262 is substantially in excess of the charge development characteristic of uncoated S-70 steel shot meeting SAE Specification J827 or SFSA Specification 20T-66 and reagent grade powdered sulphur. In fact, the triboelectric charge development capability of this developer mixture is greater than that demonstrated by uncoated S-70 steel shot meeting the above mentioned SAE or SFSA Specifications and powdered polyethylene commercially available under the name Microthene M-711-939 from U. S. I., a division of National Distillers and Chemical Corporation.

Those skilled in this art will recognize that the filtering techniques I have discovered is particularly useful for removing xerographic toner particles from air. While preferred materials have been disclosed above it will be understood that various suitable materials can be identified by techniques I have described. Accordingly, I intend my invention to be limited and defined only by the following claims.

I claim:

1. In the method of producing successive printed images wherein a physical image is produced by: conveying a development mixture of relatively large carrier particles and relatively small toner particles into operative engagement with an imaging surface bearing a differential electrostatic charge image, at least the external surfaces of said carrier particles and said toner particles being of materials having a substantial triboelectric charge development characteristic therebetween and at least one of said materials being a dielectric; transferring a substantial part of said physical image to a support surface; and mechanically dislodging toner particles that remain on said imaging surface following said transfer step and entraining said dislodged toner particles in a gaseous medium to form a mixture thereof, the improvement comprising:

collecting said entrained toner particles from said mixture by passing said mixture through a body of carrier particles that are substantially identical to the carrier particles of said development mixture whereby the toner particles adhere to the body of carrier particles, and mixing at least a portion of said body of carrier particles bearing collected toner particles into at least a portion of said development mixture.

2. The method of producing successive printed images as set forth in claim 1 wherein said triboelectric charge development characteristic is at least as great as the triboelectric charge development characteristic of steel with respect to sulfur.

3. The method of producing successive printed images as set forth in claim 1 wherein said triboelectric charge development characteristic is at least as great as the triboelectric charge development characteristic between steel and polyethylene and at least one of said materials being a dielectric.

4. The method of producing successive printed images as set forth in claim 1 further comprising the step of removing some of the developer mixture to replace said portion of said body of carrier particles mixed into said portion of developer mixture.

* * * * *